US012721441B2

(12) United States Patent
Yun

(10) Patent No.: US 12,721,441 B2
(45) Date of Patent: Sep. 1, 2026

(54) TILTABLE ARMREST ASSEMBLY AND CHAIR INCLUDING THE SAME

(71) Applicant: SIDIZ INC., Pyeongtaek-si (KR)

(72) Inventor: Hwi Seong Yun, Seoul (KR)

(73) Assignee: SIDIZ INC., Pyeongtaek-si (KR)

( * ) Notice: Subject to any disclaimer, the term of this patent is extended or adjusted under 35 U.S.C. 154(b) by 92 days.

(21) Appl. No.: 18/900,935

(22) Filed: Sep. 30, 2024

(65) Prior Publication Data

US 2025/0017376 A1 Jan. 16, 2025

Related U.S. Application Data

(63) Continuation of application No. PCT/KR2023/004424, filed on Apr. 3, 2023.

(30) Foreign Application Priority Data

Apr. 4, 2022 (KR) ..... 10-2022-0041742

(51) Int. Cl.
*A47C 1/03* (2006.01)

(52) U.S. Cl.
CPC ..... *A47C 1/0308* (2018.08); *A47C 1/0305* (2018.08)

(58) Field of Classification Search
USPC ..... 297/411.35–411.39
See application file for complete search history.

(56) References Cited

U.S. PATENT DOCUMENTS 5,655,814 A 8/1997 Gibbs
5,848,823 A * 12/1998 Su ..... A47C 1/03 297/411.36
6,773,071 B1 * 8/2004 Stasney ..... A47C 7/546 297/411.27

(Continued)

FOREIGN PATENT DOCUMENTS

CN 2772334 Y 4/2006
CN 111616543 A 9/2020

(Continued)

OTHER PUBLICATIONS

Russian Office Action for related RU Application No. 2024126608 mailed Apr. 30, 2025 from Federal Service for Intellectual Property of the Russian Federation.

(Continued)

*Primary Examiner* — Sarah B Mcpartlin
(74) *Attorney, Agent, or Firm* — Paratus Law Group, PLLC

(57) ABSTRACT

An armrest assembly includes: a fixation bracket part which is fixed to both of left and right ends of a seat plate part and has an inner space having an open upper side; a lifting part provided at the upper part of the fixation bracket part to be movable in an upward/downward direction; a tilting arm pad part provided at the upper end of the lifting part to be tiltable and slidable in a forward/backward direction; and a safety cover part which inter-operates when the tilting arm pad part is tilted and does not inter-operate when the tilting arm pad is slid, and covers a part between the lifting part and the tilting arm pad part. The tilting arm pad part has a sliding guide slot formed therein to enable a sliding movement thereof in the forward/backward direction with respect to the safety cover part.

8 Claims, 10 Drawing Sheets

(a)

(b)

(56) References Cited

U.S. PATENT DOCUMENTS

| | | | | |
|---|---|---|---|---|
| 6,811,224 | B2 * | 11/2004 | Roney | A47C 7/402<br>297/411.36 |
| 8,967,724 | B2 * | 3/2015 | Battey | A47C 31/023<br>297/411.36 |
| 2025/0017375 | A1 * | 1/2025 | Yun | A47C 1/0305 |

FOREIGN PATENT DOCUMENTS

| | | | | | |
|---|---|---|---|---|---|
| CN | 109310211 | B | * | 1/2022 | A47C 1/0307 |
| DE | 202007000037 | U1 | | 12/2008 | |
| JP | H11-155682 | A | | 6/1999 | |
| JP | 2000-279266 | A | | 10/2000 | |
| JP | 2003-079479 | A | | 3/2003 | |
| JP | 2019-072113 | A | | 5/2019 | |
| KR | 10-2041978 | B1 | | 11/2019 | |
| KR | 10-2282299 | B1 | | 7/2021 | |
| RU | 81417 | U1 | | 3/2009 | |
| WO | WO-9428772 | A1 | * | 12/1994 | A47C 1/0305 |
| WO | WO 2010/132573 | A1 | | 11/2010 | |

OTHER PUBLICATIONS

International Search Report for PCT/KR2023/004424 mailed Jul. 14, 2023 from Korean Intellectual Property Office.
Japanese Office Action for related JP Application No. 2024-558470 mailed Oct. 7, 2025 from Japan Patent Office.
Extended European Search Report for related EP Application No. 23784927.8 mailed Feb. 13, 2026 from European Patent Office.

* cited by examiner (a)

(b)

TILTABLE ARMREST ASSEMBLY AND CHAIR INCLUDING THE SAME

CROSS-REFERENCE TO PRIOR APPLICATIONS

This application is a Continuation Application of PCT International Application No. PCT/KR2023/004424 (filed on Apr. 3, 2023), which claims priority to Korean Patent Application No. 10-2022-0041742 (filed on Apr. 4, 2022), which are all hereby incorporated by reference in their entirety.

BACKGROUND

The present disclosure relates to a tiltable armrest assembly and a chair including the same, and more specifically, to a tiltable and slidable armrest assembly and a chair including the same, which can minimize user discomfort when tilting a backrest part.

FIG. 1 is an assembly example showing a portion of a chair in which an armrest assembly according to the related art is integrally assembled to a seat plate part.

Generally, as shown in FIG. 1, a chair includes a seat plate part 10 provided in the form of a cushion for a user to sit thereon, and a backrest part 20 disposed vertically at a rear end portion of the seat plate part 10 to support a user's back. A leg part 30 supported on a floor surface may be provided under the seat plate part 10, and an armrest 40 on which the user may rest his or her arms may be assembled to the seat plate part 10.

Here, as shown in FIG. 1, the backrest part 20 is provided so that an upper end portion may tilt in a front-rear direction (preferably, backward) around a lower end portion to improve the user's convenience, and the armrest 40 is also provided so that a height may be adjusted vertically according to the user's height.

However, in the case of a chair 1 in which an armrest assembly according to the related art configured as described above is integrally assembled to the seat plate part, when the backrest part 20 is tilted backward, while the user's arms are placed obliquely backward, the armrest assembly 40 is integrally provided to the seat plate part and thus an angle of the user's arm actually differs from an angle of an upper surface of the armrest assembly 40, resulting in a problem that the user complains of discomfort.

In addition, when the backrest part 20 is tilted backward, the user's arms also move a predetermined distance backward, and since the armrest assembly 40 is provided so that the height may be adjusted only vertically, there is a problem that a part where the user's arm is placed relatively moves away. That is, as shown in FIG. 1, before the backrest part 20 is tilted, a distance between the backrest part 20 and the armrest assembly 40 is "D1," and then when the backrest part 20 is tilted, the above distance becomes "D2," and thus the user's arm gets caught or the above-described user discomfort is expected.

In addition, although not shown in the drawing, even when the armrest assembly 40 is provided to slide in the front-rear direction at the same time as the tilting movement, there is a concern that a gap occurs between a tilting arm pad part and a fixing bracket part that fixes the same among components of the armrest assembly 40 when tilting to cause the user's finger, etc. to get caught in the gap, causing injury.

SUMMARY

The present disclosure has been made in efforts to solve the above problems and is directed to providing a tiltable and slidable armrest assembly and a chair including the same, in which an inclined angle is adjusted as a tilting arm pad part of the armrest assembly also slides in a front-rear direction corresponding to a tilting angle of a backrest.

In addition, the present disclosure is directed to providing an armrest assembly and a chair including the same, which can prevent a user's injury by designing a structure so that a safety cover part is linked with only tilting movement when a tilting arm pad part tilts and slides.

The objects of the present disclosure are not limited to the above-described objects, and other objects that are not described will be able to be clearly understood by those skilled in the art from the following description.

A tiltable armrest assembly according to the present disclosure includes a fixing bracket part fixed to both left and right end portions of a seating plate part and having an inner space that is open upward, a lifting part provided to move vertically on an upper portion of the fixing bracket part, a tilting arm pad part provided to move and tilt in a front-rear direction on an upper end portion of the lifting part, and a safety cover part that is linked when the tilting arm pad part tilts and not linked when sliding and covers a gap between the lifting part and the tilting arm pad part.

Here, the tilting arm pad part may be formed with a sliding guide slot to slide in the front-rear direction with respect to the safety cover part.

In addition, the safety cover part may include a guide protrusion that is guided by a sliding guide slot locked to the tilting arm pad part in a tilting direction and formed to slide in the front-rear direction on the tilting arm pad part in a sliding direction.

In addition, the tiltable armrest assembly may further include a tilting coupling part that interconnects the lifting part and the tilting arm pad part and sets a tilting rotating point of the tilting arm pad part backward with respect to a middle portion of front and back portions thereof.

In addition, the tilting coupling part may include a rotating coupling part formed integrally on an upper end portion of the lifting part and providing the tilting rotating point of the tilting arm pad part, and a rotating link part having a lower end portion hinge-fixed to an inside of the lifting part and an upper end portion hinge-fixed to the tilting arm pad part, and vertically rotating a front end portion of the tilting arm pad part by providing a user's external force.

In addition, the rotating coupling part may be coupled to slide relatively with respect to a rear end slot formed inside the tilting arm pad part.

In addition, the tilting arm pad part may include a coupling pad coupled to an upper end portion of the lifting part and a support pad which is coupled to an upper portion of the coupling pad and on which a user's arm is supported, and the safety cover part may be tilted in conjunction with the tilting arm pad part by the guide protrusion locked to the sliding guide slot, which is formed between the coupling pad and the support pad in the sliding direction, in the tilting direction.

In addition, a u-shaped safety space that is open backward may be formed between the upper end portion of the lifting part and the safety cover part.

One embodiment of a chair including an armrest assembly according to the present disclosure includes a seating plate part on which a user sits, a pair of armrest assemblies which is provided at both left and right portions of the seating plate part and on which the user's arm is placed, and a backrest part having an upper end portion provided to tilt around a lower end portion in a front-rear direction on a rear end portion of the seating plate part, wherein the pair of armrest assemblies include a fixing bracket part fixed to the both left and right end portions of the seating plate part and having an inner space that is open upward, a lifting part provided to move vertically on an upper portion of the fixing bracket part, a tilting arm pad part provided to move and tilt in a front-rear direction on an upper end portion of the lifting part, and a safety cover part that is linked when the tilting arm pad part tilts and not linked when sliding and covers a gap between the lifting part and the tilting arm pad part.

Here, the tilting arm pad part may be formed with a sliding guide slot to slide in the front-rear direction with respect to the safety cover part.

According to the armrest assembly and the chair including the same according to one embodiment of the present disclosure, it is possible to prevent the user's injury by sliding the tilting arm pad part of the armrest assembly in a front-rear direction corresponding to the tilting angle of the backrest part so that the inclined angle is adjusted and designing the structure so that the safety cover part is linked with only tilting movement when the tilting arm pad part tilts and slides.

DESCRIPTION OF REFERENCE NUMERALS

Figure 1:
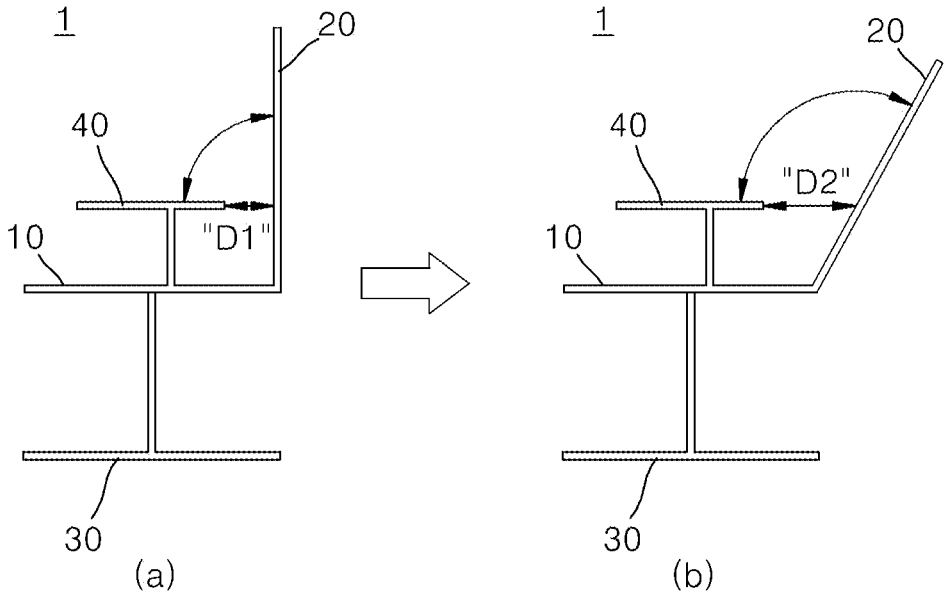
FIG. 1 is an assembly example showing a portion of a chair in which an armrest assembly according to the related art is integrally assembled to a seat plate part.

1: chair 100: armrest assembly
130: seat coupling block 140: tilting arm pad part
141: fixing bracket unit 144: lifting body
145*a*: coupling pad 145*b*: support pad
145*c*: inner pad 146: rear end block
148: sliding guide slot 150: lifting part
151: lifting box 152: locking case
153: guide panel 154: rotating lock part
154*a*: lock pin 155: lifting connection member
158: lifting button part 210: safety cover part
220: rotating coupling part 221: elastic member
230: rotating link part

DETAILED DESCRIPTION

Hereinafter, a tiltable armrest assembly and a chair including the same according to one embodiment of the present disclosure will be described in detail with reference to the accompanying drawings.

In adding reference numerals to components in each drawing, it should be noted that the same components have the same reference numerals as much as possible even when they are illustrated in different drawings. In addition, in describing embodiments of the present disclosure, the detailed description of related known configurations or functions will be omitted when it is determined that the detailed description obscures the understanding of the embodiments of the present disclosure.

The terms, such as first, second, A, B, (a), and (b) may be used to describe components of the embodiments of the present disclosure. These terms are only for the purpose of distinguishing one component from another component, and the nature, sequence, order, or the like of the corresponding component is not limited by the terms. In addition, unless otherwise defined, all terms (including technical and scientific terms) used herein have the same meanings as those commonly understood by those skilled in the art to which the present disclosure pertains. The terms defined in a generally used dictionary should be construed as meanings that match with the meanings of the terms from the context of the related technology and are not construed as an ideal or excessively formal meaning unless clearly defined in this application.

Figure 2:
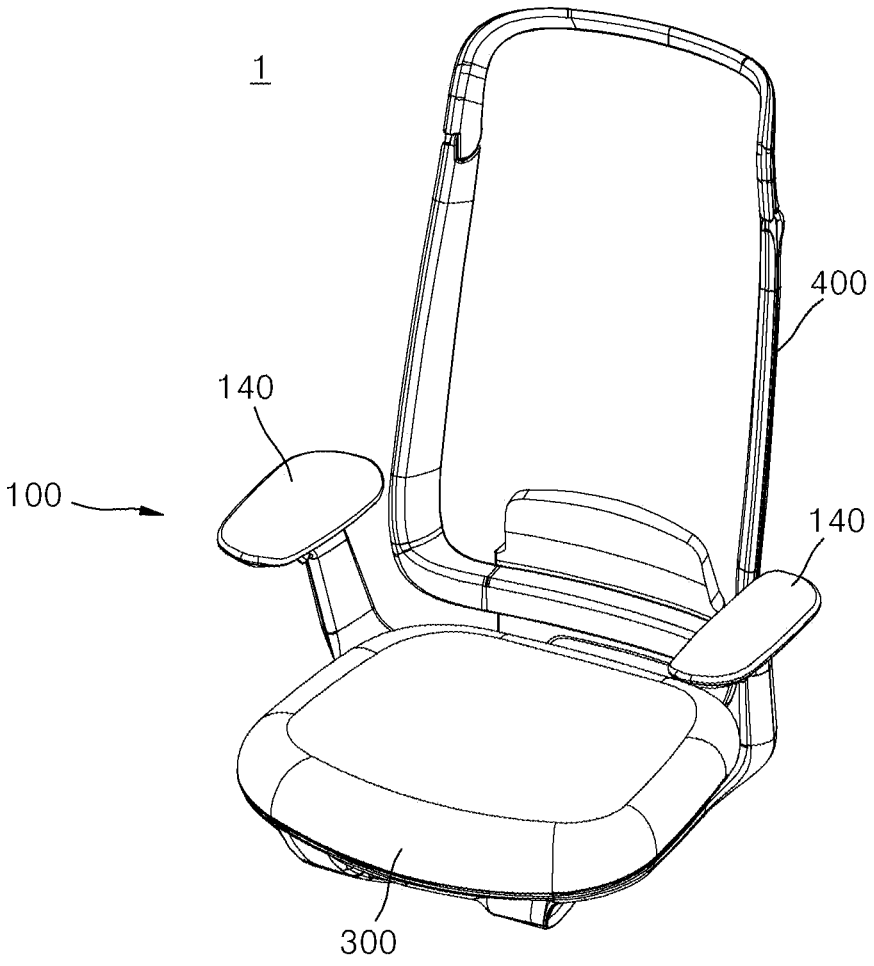
FIG. 2 is a perspective view showing an armrest assembly and a portion of an exterior of a chair including the same according to one embodiment of the present disclosure.
Figure 3:
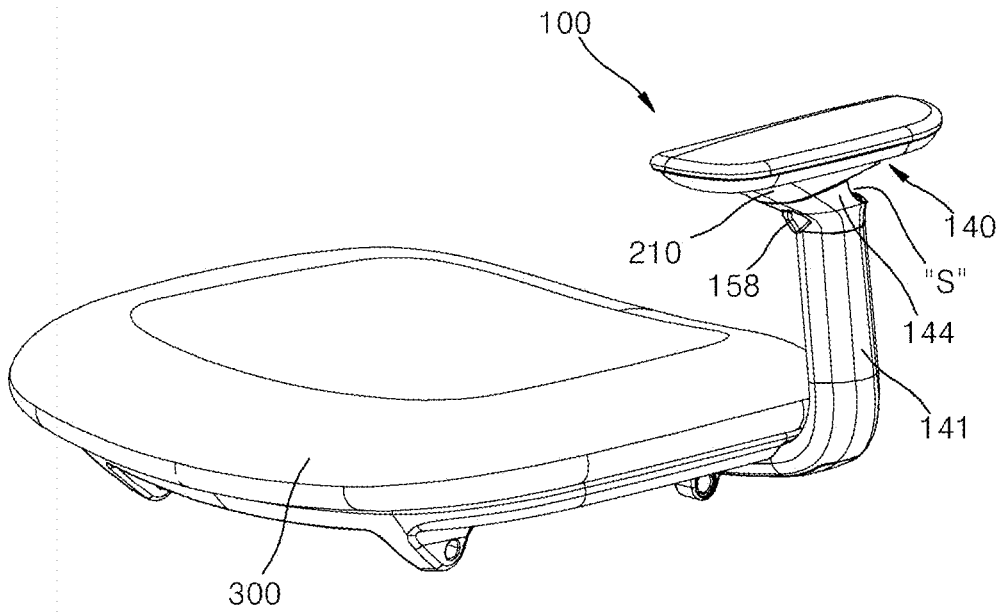
FIG. 3 is a perspective view showing a coupled state of a seat plate part and the armrest assembly.
Figure 4:
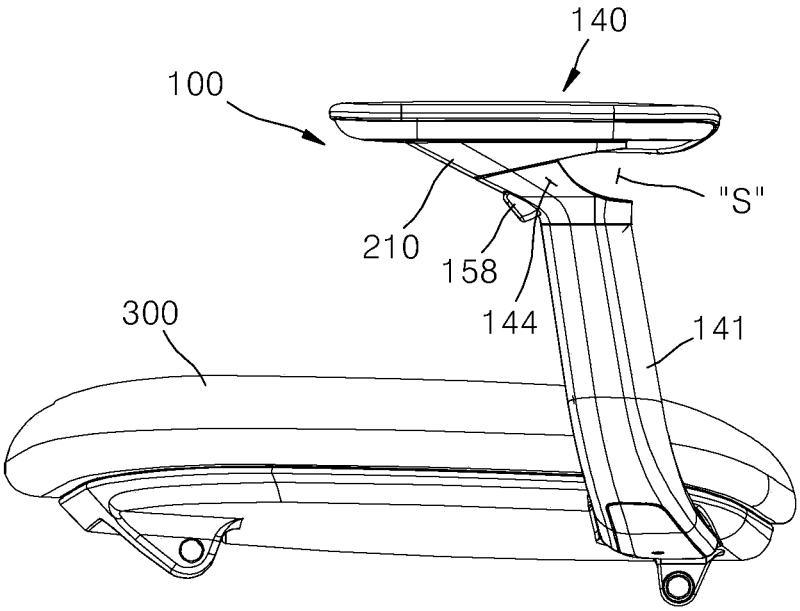
FIG. 4 is a side view of FIG. 3.
Figure 5:
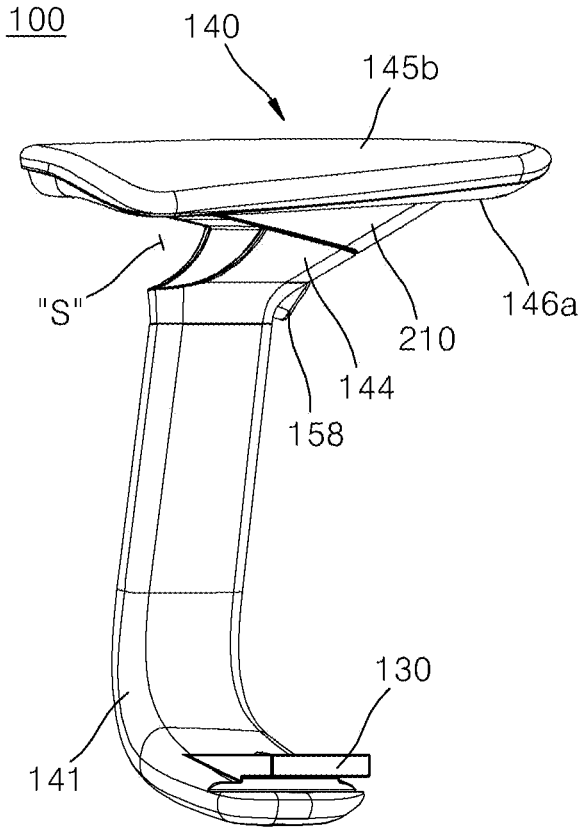
FIG. 5 is a perspective view showing the armrest assembly in a configuration of FIG. 2.
Figure 6A:
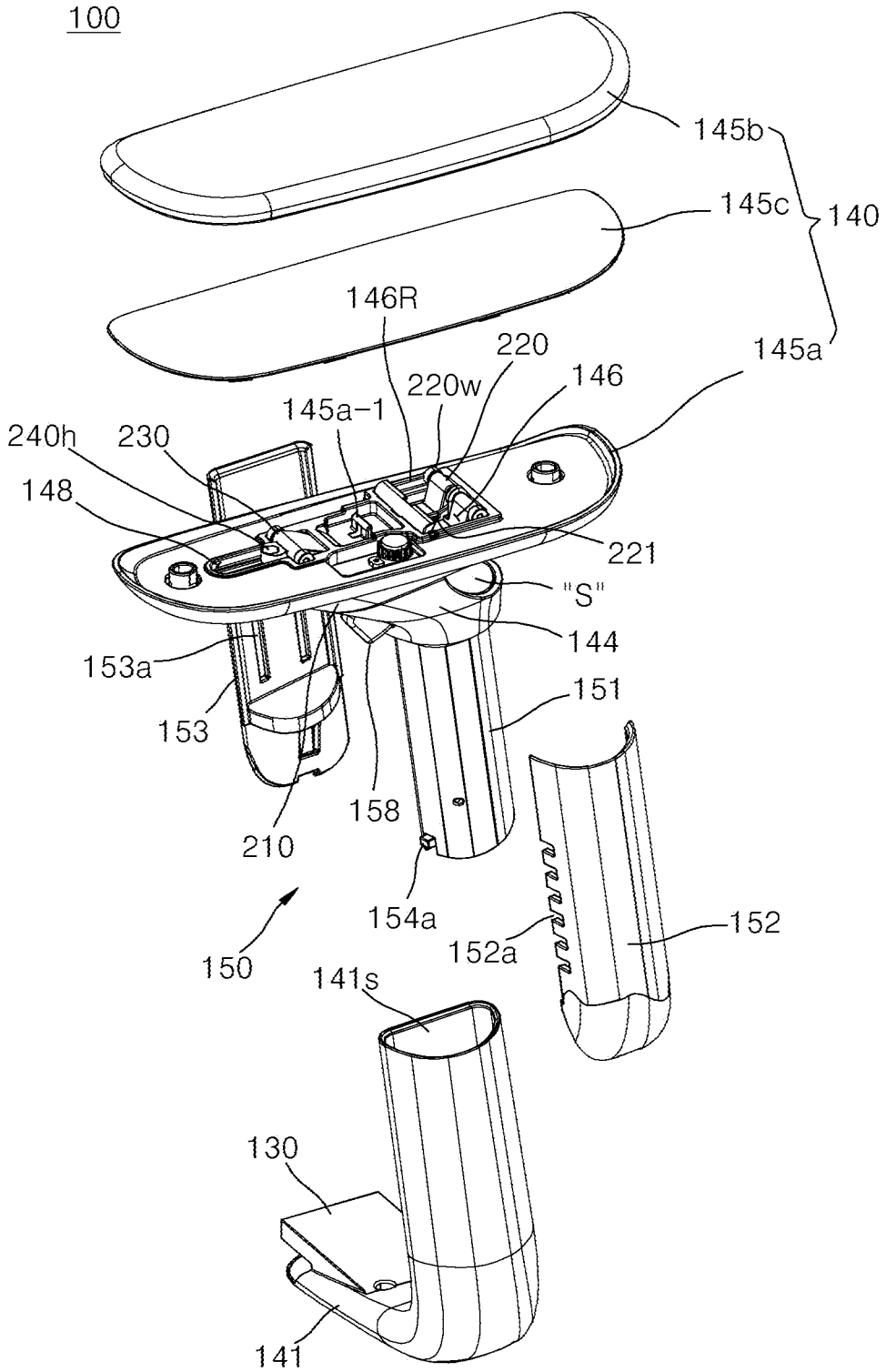
FIGS. 6A and 6B are exploded perspective views in one side and the other side directions of the armrest assembly in a configuration of FIG. 5.
Figure 6B:
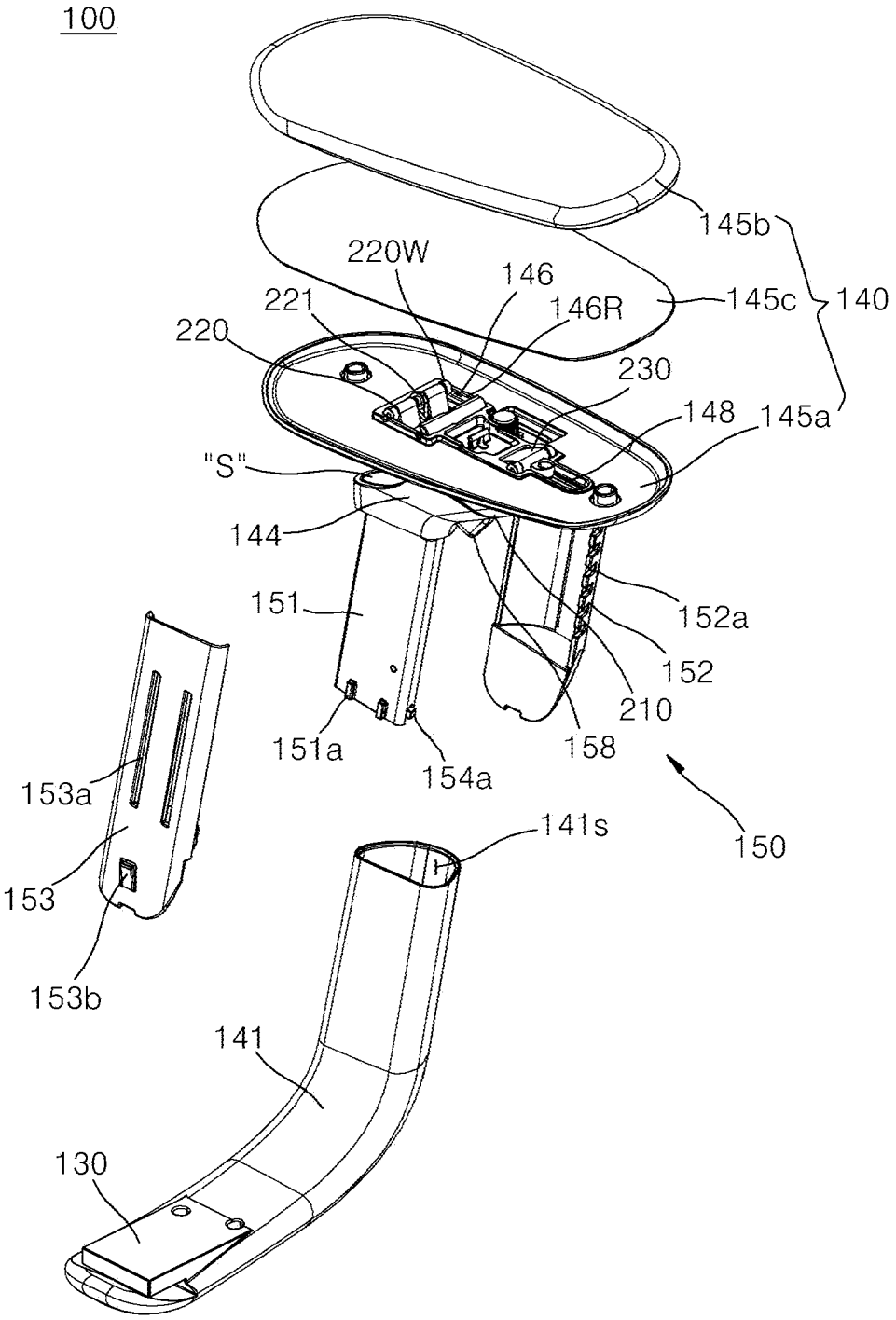

FIG. 2 is a perspective view showing an armrest assembly and a portion of an exterior of a chair including the same according to one embodiment of the present disclosure, FIG. 3 is a perspective view showing a coupled state of a seat plate part and the armrest assembly, FIG. 4 is a side view of FIG. 3, FIG. 5 is a perspective view showing the armrest assembly in a configuration of FIG. 2, and FIGS. 6A and 6B are exploded perspective views in one side and the other side directions of the armrest assembly in a configuration of FIG. 5.

According to one embodiment of the present disclosure, as shown in FIGS. 2 to 4, a chair 1 includes a seat plate part 300 provided for a user to sit thereon, a backrest part 400 provided to tilt in a front-rear direction (preferably, backward) at a rear end portion of the seat plate part 300 and supporting the user's back, a leg part (not shown) (see reference numeral 30 of FIG. 1) provided at a lower end portion of the seat plate part 300 and supported on a floor surface, and a pair of armrest assembly 100 coupled to both left and right end portions of the seat plate part 300.

Hereinafter, for convenience of description, since both the pair of armrest assemblies 100 are the same except that their configurations are formed symmetrically in a left-right direction, the description of the armrest assembly 100 provided at a right end portion of the seat plate part 300 in FIG. 2 will be replaced with the description of the armrest assembly provided at a left end portion thereof.

As shown in FIGS. 2 to 6B, the pair of armrest assemblies 100 may have a seat coupling block 130 provided at the lower end portion extending horizontally and may be firmly fixed to both end portions of left and right lower surfaces of the seat plate part 300 using a fastening member (not shown) via the seat coupling block 130.

As shown in FIGS. 2 to 6B, the armrest assembly 100 according to one embodiment of the present disclosure includes a fixing bracket part 141 fixed to the both left and right end portions of the seat plate part 300 and having an inner space 141*s* that is open upward, a lifting part 150 provided to move vertically on an upper portion of the fixing bracket part 141, a tilting arm pad part 140 provided to tilt in the front-rear direction with respect to an upper end portion of the lifting part 150, and a safety cover part 210 that is linked when the tilting arm pad part 140 tilts but is not linked when the tilting arm pad part 140 slides and covers between the lifting part 150 and the tilting arm pad part 140.

Here, the armrest assembly 100 according to one embodiment of the present disclosure may further include a tilting coupling part (no reference numeral) that interconnects the lifting part 150 and the tilting arm pad part 140 and tilts the tilting arm pad part 140 together with the safety cover part 210 around any tilting rotating point or slides only the tilting arm pad part 140 in the front-rear direction.

As shown in FIGS. 6A and 6B, the fixing bracket part 141 may be formed in a curved shape in which a lower portion extends to a lower surface side of the seat plate part 300 so that the seat coupling block 130 is coupled horizontally around substantially a middle portion and an upper portion forms an inner space 141*s* and extends upward around the middle portion.

That is, the fixing bracket part 141 is formed to be bent in an "L" shape and has a lower end portion of a horizontal area coupled to a lower portion of the seat plate part 300 via the seat coupling block 130 and coupled to have an adjustable height by vertically moving the lifting part 150 to the inner space 141*s* corresponding to an upper end portion of a vertical area.

The lower end portion excluding the upper end portion of the lifting part 150 may be coupled by being fitted into the inner space 141*s* of the fixing bracket part 141 from the top to the bottom. The lifting part 150 may be provided to move vertically within the range of an internal height formed by the inner space 141*s* of the fixing bracket part 141 so that the overall height of the armrest assembly 100 according to one embodiment of the present disclosure may be adjusted.

More specifically, as shown in FIGS. 6A and 6B, the lifting part 150 may include a lifting box 151 forming an installation space in which a rotating lock part 154 and a lifting connection member 155, which will be described below, are installed.

A locking case 152 provided to surround one side of the lifting box 151 and formed with a plurality of locking holes 152*a* vertically so that a lock pin 154*a* of the rotating lock part 154 is locked by being inserted, and a guide panel 153 provided to surround the other side of the lifting box 151, fixed to the fixing bracket part 141, and formed with a lifting guide slot 153*a* guiding the vertical movement of the lifting box 151 may be coupled to the inner space 141*s* of the fixing bracket part 141.

Here, the lock pin 154*a* of the rotating lock part 154 may be a portion provided within a rotation radius of the rotating lock part 154 and formed to rotate forward in the inner space 141*s* of the fixing bracket part 141.

A hook locking end 153*b* may be provided to protrude from an outer surface of a lower end portion of the guide panel 153, and a hook fastening groove (not shown) in which a hook locking end 153*b* is hook-fastened may be provided in a lower side of the inner space 141*s* of the fixing bracket part 141.

That is, the locking case 152 and the guide panel 153 are in a mutually coupled state, and the hook locking end 153*b* formed to protrude outward from the outer surface of the lower end portion of the guide panel 153 may be coupled by being hook-fastened to the hook fastening groove provided inside a lower end portion of the inner space 141*s* of the fixing bracket part 141.

The guide panel 153 may function to guide the vertical movement of the lifting box 151 that moves vertically when the height of the tilting arm pad part 140 to be described below is adjusted.

To this end, the guide panel 153 may have a pair of lifting guide slots 153*a* formed to extend vertically and formed to be spaced apart from each other in the front-rear direction, and a pair of lifting guide protrusions 151*a* inserted into the pair of lifting guide slots 153*a*, respectively, may be formed on the other side surface of the lifting box 151 covered by the guide panel 153.

As shown in FIGS. 6A and 6B, a lifting body 144 may be integrally formed on an upper end portion of the lifting box 151. The lifting body 144 is a portion to which the tilting arm pad part 140 is coupled to tilt or slide to an upper end portion via a rotating coupling part 220 and a rotating link part 230, which will be described below.

More specifically, the tilting arm pad part 140 may be coupled to an upper end portion of the lifting body 144 via a tilting coupling part (no reference numeral) including the rotating coupling part 220 and the rotating link part 230.

As shown in FIGS. 2 to 6B, the tilting coupling part may include the rotating coupling part 220 formed integrally with the lifting body 144 to be described below in the configuration of the lifting part 150, formed in a hinge shape that provides the tilting rotating point of the tilting arm pad part 140, and provided to protrude upward, and the rotating link part 230 having a lower end portion hinge-fixed to a hinge fixing point 230F inside the lifting part 150 and an upper end portion that vertically rotates a front end portion of the tilting arm pad part 140 while vertically rotating around the hinge fixing point 230F of the lower end portion by providing an external force.

More specifically, as shown in FIGS. 6A and 6B, the tilting arm pad part 140 may include a coupling pad 145*a* coupled to the upper end portion of the lifting part 150, a support pad 145*b* coupled to an upper portion of the coupling pad 145*a* and supporting the user's arm, and an inner pad 145*c* coupled between the coupling pad 145*a* and the support pad 145*b* to mediate coupling between the support pad 145*b* and the coupling pad 145*a*.

Here, the coupling pad 145*a* may have a rear end slot 146 formed to guide the tilting arm pad part 140 when sliding in the front-rear direction with respect to the rotating coupling part 220 integrally formed on the upper end portion of the lifting body 144.

The hinge-shaped upper end portion forming the tilting rotating point of the rotating coupling part 220 may be inserted into the rear end slot 146, and an upper end portion of the rotating coupling part 220 may be provided with a support wheel (no reference numeral) locked to the rear end slot 146 in the tilting direction of the coupling pad 145*a* and rotated when the coupling pad 145*a* slides in the sliding direction.

More specifically, the rear end slot 146 may be formed to be stepped at both left and right end portions so that a pair of support wheels are each locked in the tilting direction and formed to extend in a front-rear direction. Here, the support wheel provided in the rotating coupling part 220 provides any tilting rotating point within the range of the rear end slot 146 when the tilting arm pad part 140 tilts vertically and guides sliding movement in the front-rear direction by a predetermined distance within the range of the rear end slot 146 when the tilting arm pad part 140 slides in the front-rear direction.

At least one elastic member 221 may be interposed in the rotating coupling part 220. The at least one elastic member 221 is compressed by an external force provided by the user when the user naturally presses the rear end portion of the tilting arm pad part 140 with the elbow or pulls the tilting arm pad part 140 backward with his or her hand while tilting the backrest part 120 backward, and when the external force of the user is removed, functions to add an elastic force for restoring the tilted tilting arm pad part 140 to its original position.

The support pad 145*b* and the inner pad 145*c* may function to cover the upper portion of the coupling pad 145*a* in a state in which the rotating coupling part 220 and the rotating link part 230 are coupled by being inserted into the coupling pad 145*a* to prevent the rotating coupling part 220 and the rotating link part 230 from being observed from the outside, thereby preventing a degradation in exterior.

Meanwhile, the rotating link part 230 may be provided so that a rotating push portion 230R, which is an upper end portion, is supported on a lower surface of the inner pad 145*c* of the tilting arm pad part 140 around the lower end portion connected to the hinge fixing point 230F provided to be connected to the upper end portion of the lifting body 144.

Here, a front end of the tilting arm pad part 140 may be lifted upward or may move downward by an angle at which the rotating push portion 230R of the rotating link part 230 is rotated to enable vertical tilting movement.

In this way, the tilting arm pad part 140 may have a portion that corresponds to the front end portion relatively with respect to the upper end portion of the rotating coupling part 220 forming any tilting coupling point positioned relatively at the rear end portion and is tilted and rotated vertically by the rotating link part 230 and at the same time, may be slid in the front-rear direction within the range in which the rear end slot 146 is allowed by the external force of the user who pushes the rear end portion of the tilting arm pad part 140 with the elbow or pulls the tilting arm pad part 140 backward in a state of placing his or her arm.

Meanwhile, as shown in FIGS. 2 to 6B, an armrest assembly 100 according to one embodiment of the present disclosure may further include the safety cover part 210 that hides the rotating coupling part 220 and the rotating link part 230 from the outside and covers between the lifting part 150 and the tilting arm pad part 140.

The safety cover part 210 may be coupled to the tilting arm pad part 140 by a guide protrusion 240 protruding upward and inserted into the tilting arm pad part 140 and at the same time, tilted in conjunction with the tilting arm pad part 140 when the tilting arm pad part 140 tilts.

More specifically, the guide protrusion 240 may be inserted into the coupling pad 145*a* of the tilting arm pad part 140, and a sliding guide slot 148 may be formed to extend in the front-rear direction to be locked in the tilting direction of the tilting arm pad part 140 and to prevent the interference with the sliding direction.

The guide protrusion 240 provided on the safety cover part 210 may be fastened to a protrusion fastening end 240*h* provided on an upper end portion of the safety cover part 210.

Here, as described above, the guide protrusion 240 may be locked to both left and right end portions of the sliding guide slot 148 when the tilting arm pad part 140 tilts vertically so that the safety cover part 210 may be tilted by being linked with the vertical tilting of the titling arm pad part 140. To this end, the both left and right end portions of the sliding guide slot 148 are preferably formed so that a width of a lower end portion that is open toward the protrusion fastening end 240*h* is smaller than an outer diameter of the guide protrusion 240 provided in a roller shape.

Therefore, the safety cover part 210 is not linked with the sliding movement of the tilting arm pad part 140 by being locked to the tilting arm pad part 140 in the tilting direction by the guide protrusion 240, being not interfered by the sliding guide slot 148 in the sliding direction, and relatively allowing the sliding movement of the tilting arm pad part 140.

In this way, the safety cover part 210 is tilted by being linked with the tilting arm pad part 140 in the tilting direction of the tilting arm pad part 140 to completely block a space between the tilting arm pad part 140 and the lifting part 150 (in particular, the lifting body part 144), thereby preventing the user's body part such as a finger from being caught. However, the safety cover part 210 does not need to be linked when the tilting arm pad part 140 slides in the front-rear direction and has a non-interference structure for the sliding guide slot 148 to prevent the interference with the sliding movement of the tilting arm pad part 140 that is caused by providing the safety cover part 210.

Here, the safety cover part 210 is preferably formed to have a size that covers at least a separation distance between the front ends of the tilting arm pad part 140 and the lifting part 150 when tilted in conjunction with the tilting arm pad part 140.

Meanwhile, a U-shaped safety space S that is open backward may be formed between the upper end portion of the lifting part 150 and the rear end portion of the safety cover part 210. The U-shaped safety space S functions as a safety securement space for preventing the user's body part from being caught and injured when the tilting arm pad part 140 slides backward and the rear end portion of the tilting arm pad part 140 approaches the backrest part 120 side regardless of whether the backrest part 120 tilts.

Figure 7:
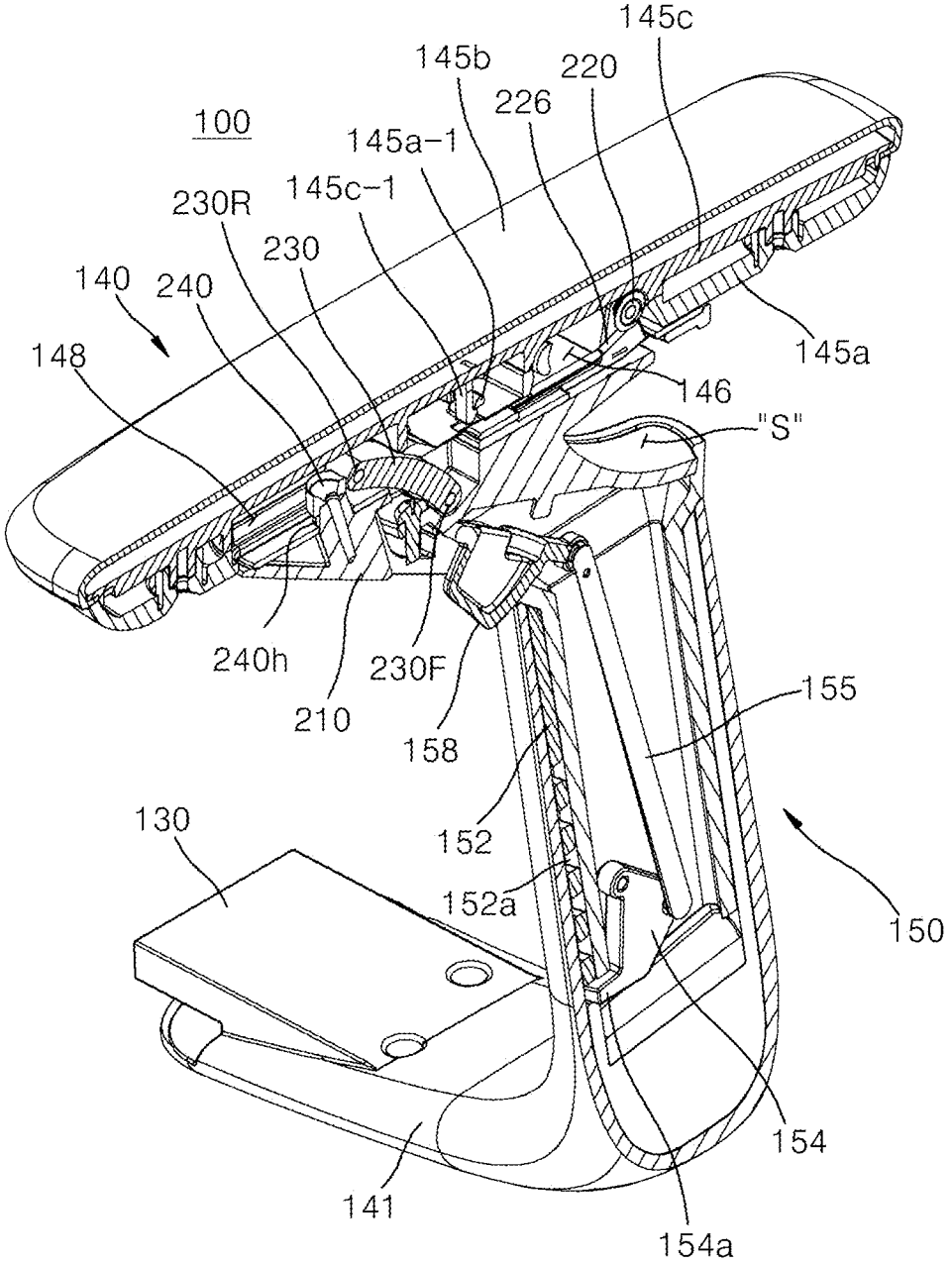
FIGS. 7 and 8 are a cut perspective view and a cross-sectional view showing internal configurations of a lifting part and a tilting arm pad part in the configuration of FIG. 5.
Figure 8:
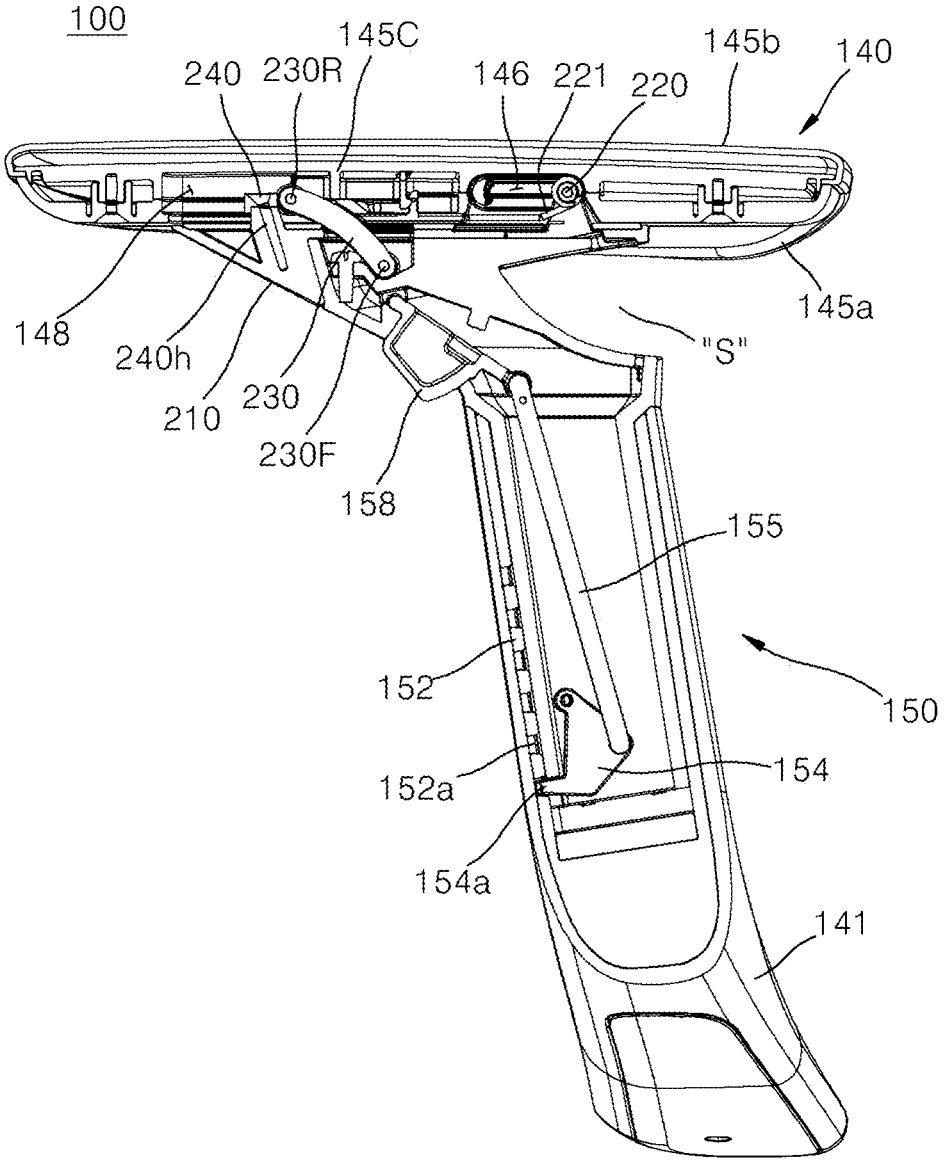
Figure 9:
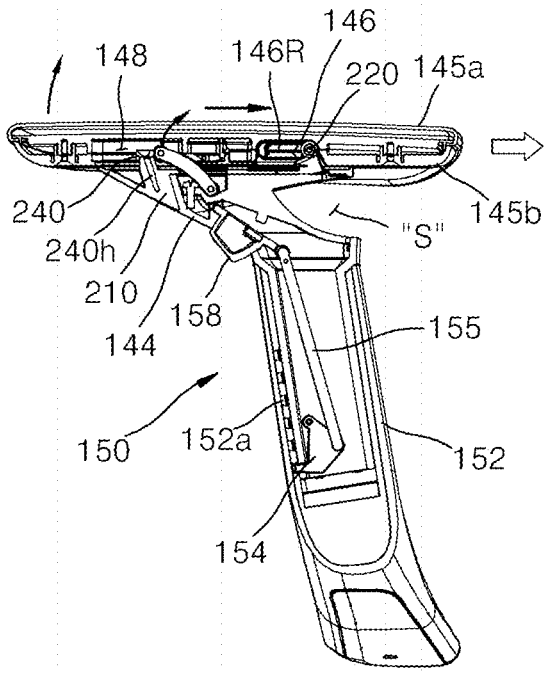
FIG. 9 is a cross-sectional view showing a tilting and sliding state of the tilting arm pad part and a safety cover part in the configuration of FIG. 5.
Figure 9:
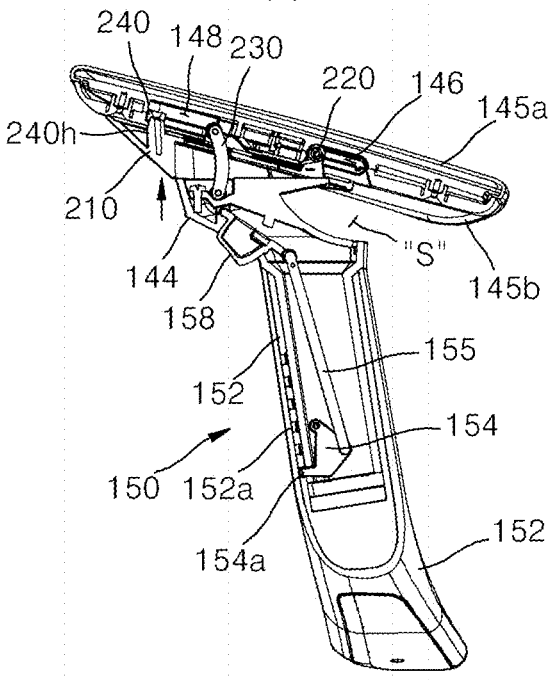
Figure 10:
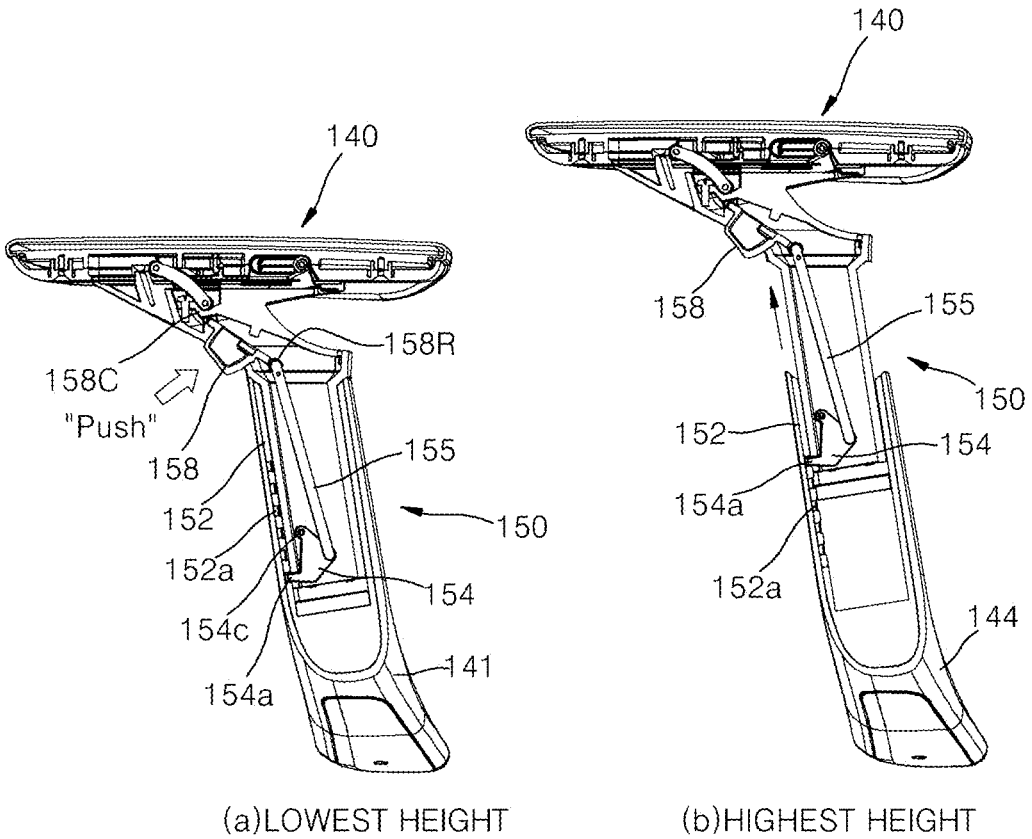
FIG. 10 is a cross-sectional view showing a height adjustment state by the lifting part in the configuration of FIG. 5.

FIGS. 7 and 8 are a cut perspective view and a cross-sectional view showing internal configurations of a lifting part and a tilting arm pad part in the configuration of FIG. 5, FIG. 9 is a cross-sectional view showing a tilting and sliding state of the tilting arm pad part and a safety cover part in the configuration of FIG. 5, and FIG. 10 is a cross-sectional view showing a height adjustment state by the lifting part in the configuration of FIG. 5.

As shown in FIGS. 7 to 10, the armrest assembly 100 according to one embodiment of the present disclosure may further include lifting locking parts 154, 155, and 158 that lift-locks or lift-unlocks the lifting part 150 and the fixing bracket part 141 by a lifting button part 158 rotated inside the lifting body 144.

As shown in FIGS. 7 and 8, the lifting locking parts 154, 155, and 158 may include the lifting button part 158 having an upper end portion hinge-fixed to have a predetermined rotating point inside the lifting body 144 forming an upper exterior of the lifting part 150 and a portion of a lower end portion exposed to the outside of the lifting part 150 upon rotation, a rotating lock part 154 provided inside the lifting box 151 inserted into the inner space of the fixing bracket part 141 and formed with the lock pin 154*a* protruding outward from the lifting box 151 by a rotating operation and locked to one of a plurality of locking holes 152*a* of the locking case 152 provided to cover one side of the lifting box 151, and a lifting connection member 155 connecting the lifting button part 158 to the rotating lock part 154.

The lifting button part 158 may be provided in a block shape exposed outward from the lifting body 144 to be substantially pushed by the user using a finger, etc. and connected to an upper end portion of the lifting connection member 155.

In addition, although not shown in the drawings, the lifting button part 158 may have an elastic member that may elastically return to its original position when an external force according to the user's pushing operation is removed.

Here, the lifting button part 158 may be exposed so that an inner end portion communicates with the inner space of the lifting box 151, the upper end portion of the lifting connection member 155 may be hinge-connected to the lifting button part 158 inside the lifting box 151, and a lower end portion of the lifting connection member 155 may be hinge-connected to the rotating lock part 154.

The rotating lock part 154 is a member that is provided to rotate around a predetermined hinge point (no reference numeral) in the inner space of the lifting box 151 and may be formed with the lock pin 154*a* to extend radially from the hinge point, and the lower end portion of the lifting connection member 155 may be connected to transmit a rotational force to the rotating lock part 154 without interfering with the lock pin 154*a*.

Here, the lock pin 154*a* of the rotating lock part 154 may be exposed to the outside through a pin hole (no reference numeral) formed in the lower end portion of the lifting box 151 and locked to one of the plurality of locking holes 152*a* formed to be spaced apart from each other vertically in the locking case 152 provided to cover the one side of the lifting box 151.

More specifically, the lifting button part 158 may be provided at a lower side of a front end portion of the lifting body 144 so that the user may easily perform a pushing operation using his or her index or middle finger, and the rotating lock part 154 may also be provided so that the lock pin 154*a* is exposed to the outside through a pin hole formed at the lower side of the front end portion of the lifting box 151 or hidden therein.

Here, when the user pushes the lifting button part 158 into the lifting body 144, the lifting connection member 155 may be pulled upward to rotate the rotating lock part 154 in the same direction, and at the same time, the lock pin 154*a* of the rotating lock part 154 may be separated from one of the locking holes 152*a* so that the user may adjust the height of the tilting arm pad part 140 by vertically applying an external force to the lifting part 150.

In addition, although the rotating lock part 154 is not shown in the drawings, a predetermined elastic member may be interposed so that the rotating lock part 154 may be elastically restored to its original position depending on whether an external force of the user is provided via the lifting connection member 155. Here, the elastic member may be provided to provide an elastic force in a direction in which the lock pin 154*a* of the rotating lock part 154 is locked by being inserted into one of the plurality of locking holes 152*a* when the external force of the user is not provided.

A sliding manipulation process of the tilting arm pad part 140 of the armrest assembly 100 in the front-rear direction according to one embodiment of the present disclosure configured as described above will be briefly described as follows with reference to the accompanying drawing (particularly, FIG. 9).

First, as shown in FIG. 9A, when a user applies an external force by pressing the rear end portion of the tilting arm pad part 140 with the elbow or pulling the tilting arm pad part 140 backward in a state of placing the arm, the front end portion of the tilting arm pad part 140 is lifted with respect to the rotating point of the rotating coupling part 220, and in this case, the upper end portion of the rotating link part 230 rotates around the hinge fixing point 230F of the lower end portion to support the tilting movement of the tilting arm pad part 140. In this case, the safety cover part 210 may be moved in the tilting movement direction in conjunction with the tilting arm pad part 140 by the guide protrusion 240 provided to be locked in the tilting movement direction by being inserted into the sliding guide slot 148 to close the gap between the lifting part 150 and the tilting arm pad part 140, thereby preventing the user's finger, etc. from being caught on the gap.

At the same time, as shown in FIG. 9B, when the user applies an external force by pressing the rear end portion of the tilting arm pad part 140 with the elbow or pulling the tilting arm pad part 140 backward in a state of placing the arm, the sliding movement of the front end portion of the tilting arm pad part 140 in the front-rear direction may be guided by the guide protrusion 240 of the safety cover part 210 inserted into the sliding guide slot 148, and the sliding movement of the rear end portion of the tilting arm pad part 140 in the front-rear direction may be guided by the support wheel of the rotating coupling part 220 inserted into the rear end slot 146.

In this case, since the rear end portion of the tilting arm pad part 140 and the rear end portion of the lifting body 144 provide sufficient safety space S that can protect the user's arms, etc., regardless of whether the backrest part 400 tilts, there is an advantage that it is possible to prevent the user's injury.

Meanwhile, a height adjustment process of the tilting arm pad part 140 of the armrest assembly 100 according to one embodiment of the present disclosure configured as described above will be briefly described with reference to the accompanying drawings (particularly, FIG. 10).

First, FIG. 10A shows a state in which the height of the tilting arm pad part 140 is adjusted to the lowest height, and when the user pushes and rotates the lifting button part 158 using the index or middle finger to re-set the height of the tilting arm pad part 140 on which the user actually places his or her arm (or elbow), the lifting button part 158 is rotated around an upper rotating point and rotated to be inserted into the lifting body 144, and in this case, when the lifting connection member 155 moves upward along the connection portion of an inner end portion of the lifting button part 158, as the rotating lock part 154 is rotated in conjunction with the above movement, the lock pin 154*a* is separated from one of the plurality of locking holes 152*a* of the locking case 152.

Here, when the user moves the tilting arm pad part 140 by an operation of vertically providing an external force in a state of pushing the lifting button part 158 and then releases the pushing manipulation of the lifting button part 158 at a desired height (e.g., the highest height as shown in FIG. 10B), as the rotating lock part 154 is rotated to be restored to its original position by an elastic member (not shown), the lock pin 154*a* may be locked by an operation fixedly inserted into the locking hole 152*a* matching the pin hole among the plurality of locking holes 152*a*.

In this way, since in the armrest assembly 100 according to one embodiment of the present disclosure, it is sufficient to interconnect the lifting button part 158 and the rotating lock part 154 using the lifting connection member 155 provided in the form of a wire, there is an advantage that the external design of the lifting button part 158 and the internal design in a narrow range of the lifting connection member 155 are very easy.

The tiltable armrest assembly and the chair including the same according to one embodiment of the present disclosure have been described above in detail with reference to the accompanying drawings. However, it goes without saying that the embodiments of the present disclosure are not necessarily limited by the above-described embodiments, and various modifications and implementation within the equivalent scope are possible by those skilled in the art to which the present disclosure pertains. Therefore, the true scope of the present disclosure will be determined by the appended claims.

There are provided an armrest assembly and a chair including the same, which can prevent a user's injury by sliding a tilting arm pad part of the armrest assembly in a front-rear direction corresponding to a tilting angle of a backrest part so that an inclined angle is adjusted and designing a structure so that a safety cover part is interworked with only tilting movement when the tilting arm pad part tilts and slides.

The invention claimed is:

1. A tiltable armrest assembly comprising:

a fixing bracket part having an inner space that is open upward;

a lifting part provided to move vertically on an upper portion of the fixing bracket part;

a tilting arm pad part provided to slide and tilt in a front-rear direction on an upper end portion of the lifting part; and a safety cover part configured to be linked to the tilting arm pad part when the tilting arm pad part tilts and configured not to be linked to the tilting arm pad part when the tilting arm pad part slides, the safety cover part being configured to cover a gap between the lifting part and the tilting arm pad part, wherein the tilting arm pad part is formed with a sliding guide slot to slide in the front-rear direction with respect to the safety cover part.

2. The tiltable armrest assembly of claim 1, further comprising a tilting coupling part that interconnects the lifting part and the tilting arm pad part and sets a tilting rotating point of the tilting arm pad part backward with respect to a middle portion of front and back portions thereof.

3. The tiltable armrest assembly of claim 2, wherein the tilting coupling part includes:

a rotating coupling part formed integrally on an upper end portion of the lifting part and providing the tilting rotating point of the tilting arm pad part; and a rotating link part having a lower end portion hinge-fixed to an inside of the lifting part and an upper end portion hinge-fixed to the tilting arm pad part, and vertically rotating a front end portion of the tilting arm pad part by providing a user's external force.

4. The tiltable armrest assembly of claim 3, wherein the rotating coupling part is coupled to slide relatively with respect to a rear end slot formed inside the tilting arm pad part.

5. The tiltable armrest assembly of claim 3, wherein a U-shaped safety space that is open backward is formed between the upper end portion of the lifting part and the safety cover part.

6. A tiltable armrest assembly comprising:

a fixing bracket part having an inner space that is open upward;

a lifting part provided to move vertically on an upper portion of the fixing bracket part;

a tilting arm pad part provided to slide and tilt in a front-rear direction on an upper end portion of the lifting part; and a safety cover part configured to be linked to the tilting arm pad part when the tilting arm pad part tilts and configured not to be linked to the tilting arm pad part when the tilting arm pad part slides, the safety cover part being configured to cover a gap between the lifting part and the tilting arm pad part, wherein the safety cover part includes a guide protrusion that is guided by a sliding guide slot locked to the tilting arm pad part in a tilting direction and formed to slide in the front-rear direction on the tilting arm pad part in a sliding direction.

7. The tiltable armrest assembly of claim 6, wherein the tilting arm pad part includes a coupling pad coupled to an upper end portion of the lifting part and a support pad which is coupled to an upper portion of the coupling pad and on which a user's arm is supported, and the safety cover part is tilted in conjunction with the tilting arm pad part by the guide protrusion locked to the sliding guide slot, which is formed between the coupling pad and the support pad in the sliding direction, in the tilting direction.

8. A chair comprising:

a seating plate part on which a user sits;

a pair of armrest assemblies provided at respective left and right portions of the seating plate part and configured to support the user's arm; and a backrest part having an upper end portion provided to tilt around a lower end portion in a front-rear direction on a rear end portion of the seating plate part, wherein the pair of armrest assemblies include:

a fixing bracket part fixed to a corresponding one of the left and right end portions of the seating plate part and having an inner space that is open upward;

a lifting part provided to move vertically on an upper portion of the fixing bracket part;

a tilting arm pad part provided to move and tilt in a front-rear direction on an upper end portion of the lifting part; and a safety cover part configured to be linked to the tilting arm pad part when the tilting arm pad part tilts and configured not to be linked to the tilting arm pad part when the tilting arm pad part slides, the safety cover part being configured to cover a gap between the lifting part and the tilting arm pad part, wherein the tilting arm pad part is formed with a sliding guide slot to slide in the front-rear direction with respect to the safety cover part.

* * * * *